US008387960B2

(12) United States Patent
Gray et al.

(10) Patent No.: US 8,387,960 B2
(45) Date of Patent: Mar. 5, 2013

(54) CLAMPING SLEEVE

(75) Inventors: Joseph Gray, St. Joseph, MO (US); Nick J. Karras, Macomb, MI (US)

(73) Assignee: Vektek, Inc., Emporia, KS (US)

( * ) Notice: Subject to any disclaimer, the term of this patent is extended or adjusted under 35 U.S.C. 154(b) by 774 days.

(21) Appl. No.: 12/554,367

(22) Filed: Sep. 4, 2009

(65) Prior Publication Data

US 2010/0050859 A1 Mar. 4, 2010

Related U.S. Application Data

(60) Provisional application No. 61/094,284, filed on Sep. 4, 2008.

(51) Int. Cl.
*B25B 1/00* (2006.01)

(52) U.S. Cl. ..... 269/20; 279/4.11

(58) Field of Classification Search ..... 269/25, 269/287, 22; 279/411, 66, 4.11; 403/223, 403/359.1; 439/730; 411/80.5; 174/68.1; 81/121.1; 294/119.3; 92/26; 188/67; *H01R 4/72*
See application file for complete search history.

(56) References Cited

U.S. PATENT DOCUMENTS 3,608,161 A * 9/1971 Kost et al. ..... 24/463
3,942,407 A * 3/1976 Mortensen ..... 411/36

FOREIGN PATENT DOCUMENTS

EP 491616 A1 * 6/1992

OTHER PUBLICATIONS

Meier, J.H. "Efficiency of a Corrugated Shell as a Radial Spring," Experimental Mechanics, vol. 2, No. 10; Oct. 1962 (4 pages).

* cited by examiner

*Primary Examiner* — Lee D Wilson
*Assistant Examiner* — Jamal Daniel
(74) *Attorney, Agent, or Firm* — Hovey Williams LLP

(57) ABSTRACT

A clamping sleeve is of generally cylindrical shape with a hollow interior and comprises an upper crown, a lower crown, and a tubular sidewall. The upper crown is positioned at an upper end of the clamping sleeve. The lower crown is positioned at a lower end of the clamping sleeve. The tubular sidewall is positioned between the upper and lower crown and includes one or more corrugations that utilize spring like principles such that pressure applied to the external surface of the tubular sidewall circumferentially flexes the clamping sleeve in order to reduce the diameter of the clamping sleeve and apply a clamping force to an object within the clamping sleeve. The clamping sleeve may be utilized in a work support that includes a plunger positioned within the clamping sleeve, wherein a pressurized flowable medium provides pressure to the exterior of the tubular sidewall thereby causing the clamping sleeve to apply a clamping force to the plunger.

21 Claims, 3 Drawing Sheets

CLAMPING SLEEVE

RELATED APPLICATIONS

This nonprovisional patent application claims priority benefit, with regard to all common subject matter, of earlier-filed U.S. provisional patent application titled "CLAMPING SLEEVE", Ser. No. 61/094,284, filed Sep. 4, 2008. The identified earlier-filed application is hereby incorporated by reference in its entirety into the present application.

BACKGROUND OF THE INVENTION

1. Field of the Invention

Embodiments of the present invention relate to clamping sleeves. More particularly, embodiments of the present invention relate to clamping sleeves that hold an object in a desired position, preventing axial and rotational movement, while the object is subjected to various loads.

2. Description of the Related Art

Clamping sleeves are generally utilized to hold an object, such as a rod or a plunger, in a desired position while the object is subjected to various loads. Clamping sleeves are utilized in many applications including hydraulic work supports. The typical clamping sleeve in a hydraulic work support is cylindrical in shape with a hollow interior such that the sleeve resembles a tube. The clamping sleeve is usually positioned upright in the work support and receives the plunger in an orientation perpendicular to the mounting plane. The plunger receives an axial load from a work piece that rests upon the end of the plunger. The clamping sleeve is usually surrounded by a pressurized chamber that typically derives its pressure from a liquid medium. The clamping sleeve holds the plunger in a fixed position by transferring a portion of the pressure that is applied to its outer surface by the liquid medium to the surface of the plunger. The pressure on the clamping sleeve generally causes circumferential compression of the clamping sleeve material so that the inner surface of the clamping sleeve contacts the outer surface of the plunger and holds the plunger in a fixed position.

Clamping sleeves are typically manufactured from metal, such as stainless steel, spring steel, or bronze, and are difficult to contract. In order to contract the clamping sleeve so that it can provide a clamping force, the circumference of the sleeve must compress to establish contact with the plunger. There are a few drawbacks to this approach. The input pressure that is needed to establish contact between the clamping sleeve and the plunger (or remove the clearance) may not be used to apply a clamping force to the plunger—thereby the clearance between the clamping sleeve and plunger must be minimal and the clamping sleeve wall must be thin such that excess pressure is not required for the sleeve to function. In addition, the clamping sleeve may not contract or compress uniformly and may not hold the plunger with a repeatable pressure. As a result, the sleeve may be difficult to repeatably manufacture in high volume with acceptable tolerances. Therefore, clamping sleeves, as described above, may be costly and time consuming to manufacture, may have lower repeatability, and may have generally inferior performance.

SUMMARY OF THE INVENTION

Embodiments of the present invention solve the above-mentioned problems and provide a distinct advance in the art of clamping sleeves. More particularly, embodiments of the invention provide a clamping sleeve that includes one or more corrugations using spring-like principles to circumferentially flex the sleeve for increased closing efficiency which in turn allows the clearance between the clamping sleeve and rod to be greater and the clamping sleeve wall to be thicker. Thus, the clamping sleeve is easier to manufacture and possesses greater strength and stability to resist deformation under heavy loads.

In various embodiments of the present invention, the clamping sleeve is of generally cylindrical shape with a hollow interior and comprises a tubular sidewall, an upper crown, and a lower crown. The upper crown is positioned at an upper end of the tubular sidewall, and the lower crown is positioned at a lower end of the tubular sidewall. The upper crown and the lower crown are generally thicker than the tubular sidewall and act in combination to maintain a desired pressure therebetween.

The tubular sidewall is positioned between the upper crown and the lower crown and includes one or more corrugations which allow the tubular sidewall to circumferentially flex, such that pressure applied to the external surface of the tubular sidewall decreases the circumference of the clamping sleeve. In turn, the decrease in the circumference removes the clearance between the sleeve and the rod. Any further increase in the pressure on the tubular sidewall may lead to the clamping sleeve applying a clamping force to an object within the clamping sleeve.

In various embodiments of the present invention, the clamping sleeve may be utilized as a clamping mechanism of a work support that includes an object such as a plunger which is positioned within the clamping sleeve and receives a load from a work piece that is placed on top of the end of the object. The work support may also include a body with a coaxial sleeve that creates a pressurizing chamber. Pressurized liquid or gas medium may fill the pressurizing chamber and exert a pressure on the tubular sidewall section of the clamping sleeve. As the pressure increases, the corrugations of the clamping sleeve flex, reducing the circumference of the sleeve and in turn the inner diameter so that the clamping sleeve contacts the object. With a further increase in pressure, the clamping sleeve applies a clamping force to the object, holding the object firmly in place.

This summary is provided to introduce a selection of concepts in a simplified form that are further described below in the detailed description. This summary is not intended to identify key features or essential features of the claimed subject matter, nor is it intended to be used to limit the scope of the claimed subject matter.

Other aspects and advantages of the present invention will be apparent from the following detailed description of the embodiments and the accompanying drawing figures.

BRIEF DESCRIPTION OF THE DRAWING FIGURES

Embodiments of the present invention is described in detail below with reference to the attached drawing figures, wherein.

Figure 1:
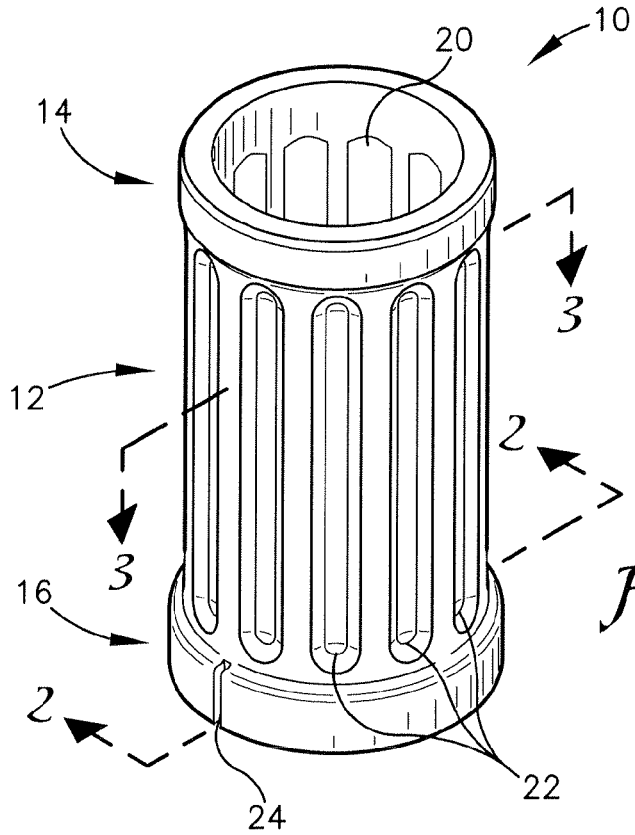
FIG. 1 is a perspective view looking down at a clamping sleeve constructed in accordance with various embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
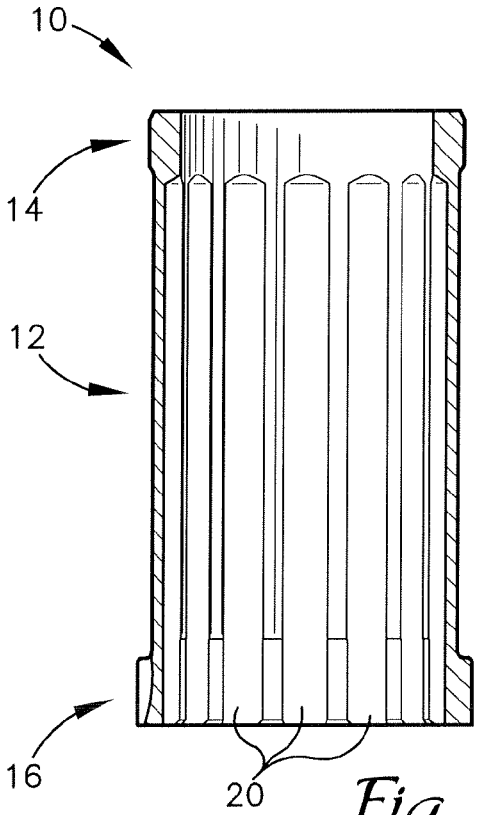
FIG. 2 is a sectional view of the clamping sleeve cut along a vertical plane (2-2 of FIG. 1) through the central axis of the clamping sleeve.
Figure 3:
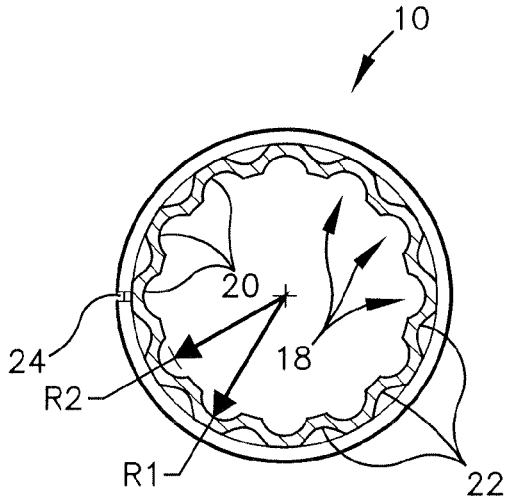
FIG. 3 is a sectional view of the clamping sleeve cut along a horizontal plane (3-3 of FIG. 1) near the center of the clamping sleeve.

A clamping sleeve 10, constructed in accordance with various embodiments of the present invention, is shown in FIGS. 1-3. The clamping sleeve 10 is generally monolithic in construction and broadly comprises a tubular sidewall 12, an upper crown 14, and a lower crown 16. The clamping sleeve 10 is generally cylindrical in shape with a hollow interior and an inner surface and an outer surface. The clamping sleeve 10 may have a generally constant inner diameter along the longitudinal axis, but the outer diameter, and thus the thickness, of the clamping sleeve 10 may vary depending on the section. The clamping sleeve 10 is generally rigid and may be manufactured from metal, such as stainless steel, spring steel, bronze, or the like.

The tubular sidewall 12 is generally elongated and located in the central region of the clamping sleeve 10 between the upper crown 14 and the lower crown 16. The tubular sidewall 12 section of the clamping sleeve 10 may have a smaller outer diameter, and thus thickness, than the upper crown 14 and the lower crown 16. The tubular sidewall 12 includes at least one corrugation 18 that extends along at least a portion of the length of the tubular sidewall 12. As described and claimed herein, "corrugation" may include a section along the circumference of the tubular sidewall 12 wherein a first inner radius R1 of the tubular sidewall 12 for that section is greater than a second inner radius R2 of adjacent sections of the circumference of the tubular sidewall 12, as seen in FIG. 3. The second inner radius R2 is generally the inner radius of the clamping sleeve 10 in any non-corrugated portion. In this manner, the corrugation 18 may be seen as an outward protruding region from the tubular sidewall 12. The cross-sectional shape of the corrugation 18 may be generally rounded (e.g., circular, elliptical, broadly oval, etc.) such that the inner radius of the tubular sidewall 12 gradually increases from the edge of the corrugation 18 toward the center of the corrugation 18. However, other cross-sectional shapes of the corrugation 18 may be possible, such as triangular or rectangular. In addition, the thickness of the clamping sleeve 10 may be non-uniform across the cross-sectional length of the corrugation 18. Thus, the center of the corrugation 18 along the circumference of the tubular sidewall 12 may be thicker or thinner than the edges of the corrugation 18.

In various embodiments, the tubular sidewall 12 includes a plurality of corrugations 18. A clamping sleeve 10 with twelve corrugations 18 is shown in FIGS. 1-3. The corrugations 18 are generally uniformly spaced along the circumference of the tubular sidewall 12, although non-uniform spacing is possible. The corrugations 18 may be formed by creating a plurality of recesses 20 on the inner surface of the tubular sidewall 12 interleaved with a plurality of recesses 22 on the outer surface of the tubular sidewall 12. Hence, each corrugation 18 may be defined by the location of one recess 20 on the inner surface and the region between two adjacent half recesses 22 on the outer surface of the tubular sidewall 12. The recesses 20, 22 on the inner surface and the outer surface may be formed by broaching, milling, or other methods of removing material from or forming the tubular sidewall 12 along the length of the clamping sleeve 10. The recesses 20, 22 on the inner surface and the outer surface may have a generally rounded cross-sectional shape, e.g., circular, elliptical, broadly oval, roughly parabolic, etc. Furthermore, the cross-sectional shape of the inner recess 20 may differ from the cross-sectional shape of the outer recess 22, as best seen in FIG. 3. However, the recesses may have other cross-sectional shapes, such as triangular or rectangular. In addition, the upper and lower ends of the recesses 20, 22, along the longitudinal axis of the clamping sleeve 10, may have a rounded or curved shape when viewed along an axial cross section of the clamping sleeve 10. Alternatively, the ends of the recesses 20, 22 may have an angled or orthogonal shape. In various embodiments, the recesses 20 of the inner surface of the tubular sidewall 12 may be interrupted between the upper crown 14 and the lower crown 16 and include discontinuities such as full or partial length recesses 20 and may have different lengths or multiple lengths staggered through the interior angular orientation of the clamping sleeve 10.

Figure 4:
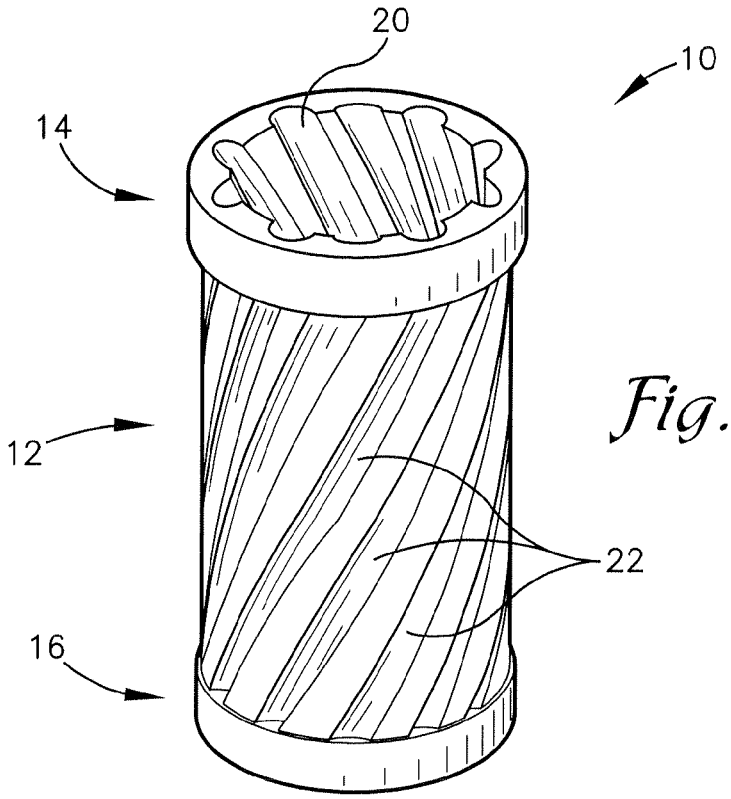
FIG. 4 is a perspective view looking down at an alternative embodiment of the clamping sleeve that includes helical corrugations.

Although the corrugation 18 may be axially-aligned, as seen in FIGS. 1-3, other configurations are possible, The corrugation 18, or plurality of corrugations 18, may be formed at an angle on the surface of the tubular sidewall 12 that extend along the length, or at least a substantial portion of the length, of the tubular sidewall 12. In various embodiments, the corrugation 18 may have a spiral or helical orientation with respect to the longitudinal axis of the clamping sleeve 10, as seen in FIG. 4. Similar orientations of the corrugation 18 that are not parallel the longitudinal axis of the clamping sleeve 10 are also possible.

Each corrugation 18 generally provides a point of flexure when surface-normal, radially inward forces are applied to the outer surface of the tubular sidewall 12. Thus, the edges of each corrugation 18 may flex or pivot slightly about the center of the corrugation 18 when external pressure is applied to the outer surface of the clamping sleeve 10. As a result, the circumference of the inner surface of the tubular sidewall 12 may contract slightly, such that the effective inner diameter of the tubular sidewall 12 is slightly smaller when external pressure pushes the tubular sidewall 12 inward. The amount of inward travel that the tubular sidewall 12 experiences when a radially inward force is applied may depend on a variety of factors, including, but not limited to, the amount of the applied force (or pressure), the physical properties (such as modulus of elasticity) of the material used to manufacture the clamping sleeve 10, the number of corrugations 18 implemented on the tubular sidewall 12, the size and geometry of each corrugation, the clearance between the internal diameter of the clamping sleeve 10 and the object positioned within, etc.

The contraction of the circumference of the inner surface of the tubular sidewall 12 as a result of pressure on the outer surface of the clamping sleeve 10 may, in turn, exert a pressure on an object positioned within the inner diameter of the clamping sleeve 10. The object may be cylindrical with similar dimensions to that of the clamping sleeve 10 except that the outer diameter of the object is slightly less than the inner diameter of the clamping sleeve 10. Thus, when the clamping sleeve 10 is relaxed, there is sufficient clearance between the object and the clamping sleeve 10 for the object to move freely along the longitudinal axis of the sleeve 10. However, as external pressure is applied to the clamping sleeve 10, the circumference of the inner surface of the sleeve 10 contracts and the inner diameter of the tubular sidewall 12 decreases so that the inner surface of the clamping sleeve 10 contacts the outer surface of the object. As the external pressure increases, the tubular sidewall 12 section of the clamping sleeve 10 applies a clamping force to the object—rigidly holding the object in a fixed position, even as axial and rotational loads may be applied to the object. Therefore, pressure on the outer surface of the clamping sleeve 10 provides a resistive force to an axial and rotational load on the object held within the inner diameter of the clamping sleeve 10.

The upper crown 14 includes a region from an upper end of the clamping sleeve 10 downward wherein the thickness from the inner diameter of the clamping sleeve 10 to the outer diameter of the upper crown 14 is uniform. The outer surface of the clamping sleeve 10 may be generally smooth in the upper crown 14 section.

The lower crown 16 includes a region from a lower end of the clamping sleeve 10 upward wherein the thickness from the inner diameter of the clamping sleeve 10 to the outer diameter of the lower crown 16 is uniform. In some embodiments, the thickness of the lower crown 16 may be greater than the thickness of the upper crown 14. Accordingly, the outer diameter of the clamping sleeve 10 may be greater at the lower crown 16 than the outer diameter at the upper crown 14. The larger diameter of the lower crown 16 allows the clamping sleeve 10 to be conveniently and securely positioned when the sleeve 10 is utilized in an apparatus. The outer surface of the clamping sleeve 10 is generally smooth in the lower crown 16 section. In other embodiments, the thickness of the lower crown 16 may be less than or equal to the thickness of the upper crown 14.

In various embodiments, the lower crown 16 may also include a first passageway 24 that extends longitudinally along the outer surface of the lower crown 16. The first passageway 24 may be a narrow slit that allows a pressurized flowable medium from an external source to flow into the space surrounding the exterior of the tubular sidewall 12. As described herein, "flowable medium" may be a liquid or a gas medium.

In an exemplary embodiment, the clamping sleeve 10 has the following dimensions. The length of the clamping sleeve 10 is approximately 1.843 inches. The inner diameter of the clamping sleeve 10 is approximately 0.750 inches. The thickness of the upper crown 14 is approximately 0.093 inches. The length of the upper crown 14 is approximately 0.169 inches. The length of the lower crown 16 is approximately 0.202 inches. The thickness of the lower crown 16 is approximately 0.121 inches. The width of the first passageway 24 is approximately 0.029 inches. The length of the tubular sidewall 12 is approximately 1.472 inches. The length of a corrugation 18 is approximately 1.625 inches. The thickness of a corrugation 18 is approximately 0.035 inches. The outer diameter of the tubular sidewall 12 is approximately 0.908 inches. The outer recess 22 has a roughly parabolic cross-sectional shape with a width of approximately 0.157 inches and a depth of approximately 0.044 inches. The inner recess 20 has a 0.058-inch radius circular cross-sectional shape that is cut to a depth of 0.044 inches.

Generally, the pressure exerted to the exterior of the clamping sleeve 10 increases from zero to a desired application pressure. As discussed above, at a certain level of pressure, the gap between the inner surface of the tubular sidewall 12 and the object positioned within the clamping sleeve 10 diminishes to where the tubular sidewall 12 contacts the object. The portion of pressure used to remove the gap between the inner surface of tubular sidewall 12 and the object positioned within the clamping sleeve 10 cannot be used to apply a clamping force to the object. The increased closing efficiency of the clamping sleeve 10 can be illustrated by calculating the approximate external pressure required to remove a given clearance from an exemplary prior art clamping sleeve and comparing the value to the approximate external pressure to remove the same clearance from the present invention. In this example, the prior art clamping sleeve may resemble a cylindrical tube with a substantially smooth inner wall and a substantially smooth outer wall wherein the outer diameter is slightly greater than the inner diameter.

Both the clamping sleeve of the prior art and the clamping sleeve of the current invention may have the following properties. The inner radius, R, equals 0.375 inches. The modulus of elasticity, E, equals 27,500,000 lb/in$^2$. The clearance per side, $\Delta R$, between the clamping sleeve and object equals 0.0005 inches. The wall thickness, t, equals 0.035 inches.

The pressure required to close the gap between the clamping sleeve of the prior art and the object may be derived from Roark's Formulas for Stress and Strain, Seventh Edition, published Sep. 13, 2001, pages 585-592, which is hereby incorporated by reference, and is given by EQ. 1.

$$P = \frac{t\Delta RE}{R^2 + tR} \qquad \text{EQ. 1}$$

Plugging the variables listed above into EQ. 1 yields that the pressure, P, required to close the gap between the clamping sleeve of the prior art and the object equals 3130 pounds per square inch (psi).

The pressure required to close the gap between the clamping sleeve of the current invention and the object may be derived from "Efficiency of a Corrugated Shell as a Radial Spring" from Experimental Mechanics, Volume 2, Number 10, published October, 1962, pages 312-315, which is hereby incorporated by reference, and is given by EQ. 2.

$$P = \frac{2\pi\Delta RIE}{nR(1 - v^2)c^2z^2[f_1(z)]w} \qquad \text{EQ. 2}$$

wherein the moment of inertia, I, of the shell wall equals 0.0000036 in$^3$; the number of corrugations, n, equals 12; Poisson's ratio, v, of the shell material equals 0.3; the length, c, which is half the length of the chord formed between the midpoints of the sleeve contact lands, equals 0.0971 inches; the steepness factor, z, which relates to the length, c, and the height of a corrugation, equals 0.5726; the flexibility factor, $f_1(z)$, equals 0.144; and the length, w, of the chord formed between the midpoints of the exterior recesses of the corrugations equals 0.212 inches. Plugging the variables listed above into EQ. 2 yields that the pressure, P, required to close the gap between the clamping sleeve of the current invention and the object equals 806 psi—3.88 times less than the prior art clamping sleeve. Any external pressure greater than 806 psi may be applied to generating a clamping force on the object held within the sleeve. Since the clamping sleeve of the prior art may start generating a clamping force above 3130 psi, the clamping sleeve of the current invention starts generating a clamping force at a much lower external pressure than the prior art.

Figure 5:
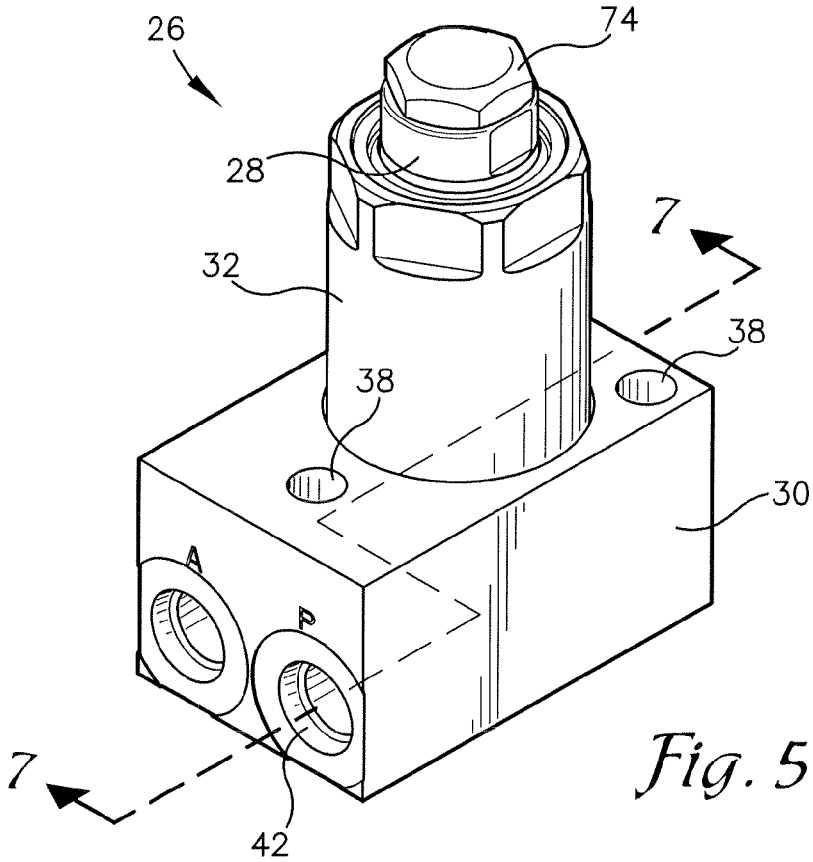
FIG. 5 is a perspective view looking down at a work support which includes the clamping sleeve.
Figure 6:
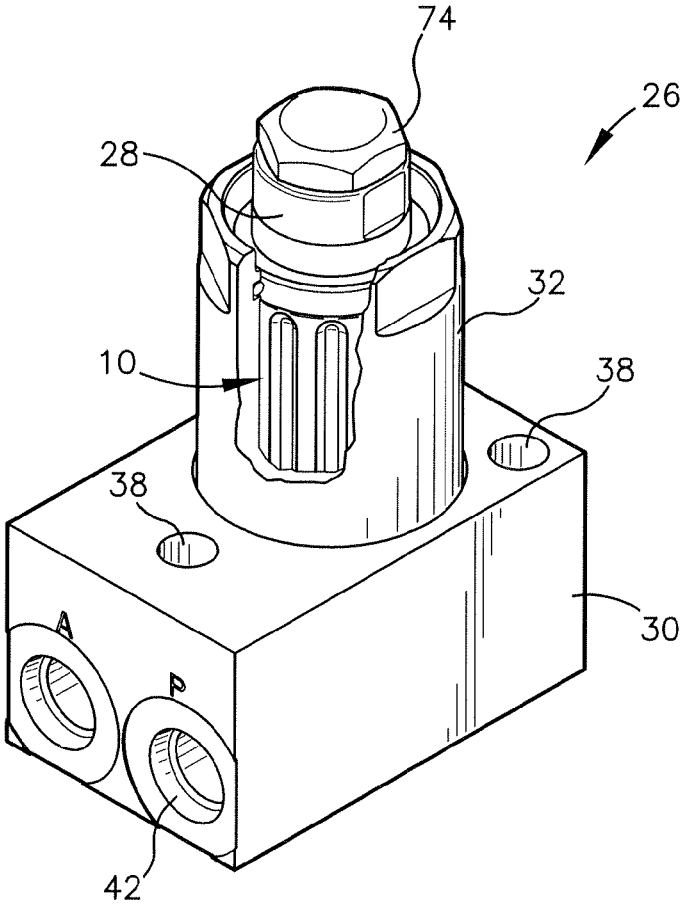
FIG. 6 is a perspective view looking down at the work support with a portion of a body removed to reveal an upper crown and tubular sidewall of the clamping sleeve.
Figure 7:
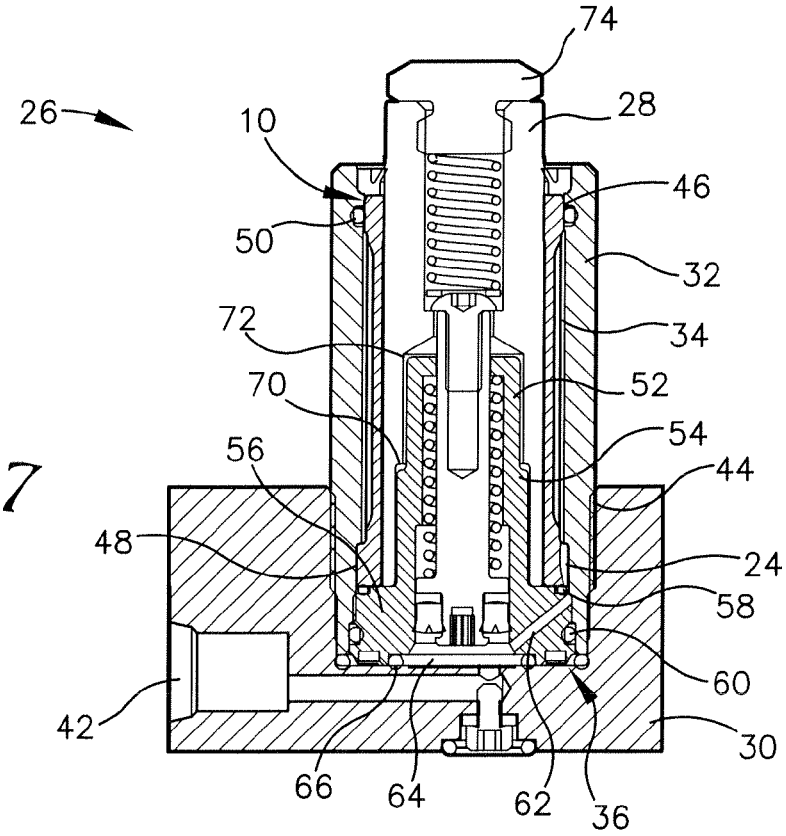
FIG. 7 is a sectional view of the work support cut along a vertical plane (6-6 of FIG. 4) showing a port and passageways of the work support.

The clamping sleeve 10 generally receives an object within the inner diameter which is to be held, or clamped, in a desired, fixed position, typically while the object is under load. Accordingly, the clamping sleeve 10 is often utilized in a hydraulic work-holding system that functions as a clamping mechanism. An example of the clamping mechanism is a hydraulic work support 26, as shown in FIGS. 5-7. In the hydraulic work support 26, the clamping sleeve 10 may receive a plunger 28 which is to be held in a fixed position while the plunger 28 is under load from a work piece. The work support 26 may also comprise a base 30, a body 32, a pressurized chamber 34, and a retainer 36.

The base 30, as seen in FIGS. 5-6, is generally of rectangular box shape which may include one or more holes 38 for mounting the work support 26 to a frame, a fixture, a tabletop, or the like. The base 30, as seen in FIG. 7, may also include a port 42 for a pressurized flowable medium. In addition, the base 30 may include a cylindrical threaded opening 44 to receive the body 32.

The body 32, as best seen in FIG. 7, is generally cylindrical in shape with an outer surface that is often threaded to couple with the base 30 or a fixture cavity. The body 32 may include a hollow interior that is greater in length than the clamping sleeve 10. The clamping sleeve 10 may be received within the body 32 such that when the clamping sleeve 10 is properly positioned, the outer surface of the upper crown 14 contacts an upper band 46 of the body 32 and the outer surface of the lower crown 16 contacts a lower band 48 of the body 32. A first resilient O-ring 50 may be positioned between the upper crown 14 and the upper band 46. The upper edge of the lower crown 16 may rest against a ridge on the inner surface of the body 32 just above the lower band 48. Furthermore, there may be a gap between the inner surface of the body 32 and the outer surface of the tubular sidewall 12 section of the clamping sleeve 10, which creates the pressurized chamber 34.

The retainer 36 is generally cylindrical in shape with a hollow interior and includes an upper tier 52, a middle tier 54, and a lower tier 56. The upper tier 52 may have a smaller inner and outer diameter than the middle tier 54, which is coupled to the lower portion of the upper tier 52. The lower tier 56 generally has the same inner diameter as the middle tier 54 but has a significantly greater outer diameter than the middle tier 54, wherein the upper surface of the lower tier 56 forms a stage. The outer surface of the lower tier 56 may include threads and the lower portion of the inner surface of the body 32 may also include threads. The retainer 36 is received within the body 32 such that the outer surface of the lower tier 56 is threadably coupled with the lower portion of the inner surface of the body 32. While the retainer 36 is in this position, the upper surface of the lower tier 56 may contact the lower crown 16 of the clamping sleeve 10 and press the lower crown 16 into the ridge on the inner surface of the body 32, thereby firmly maintaining the position of the clamping sleeve 10 within the body 32. A second resilient O-ring 58 may be positioned between the upper surface of the lower tier 56 and the lower crown 16. A third resilient O-ring 60 may be positioned between the outer surface of the lower tier 56 and the lower portion of the body 32 inner surface.

The retainer 36 may also include a second passageway 62 and a piston bore 64 to allow a flowable medium to flow from the port 42 to the pressurized chamber 34. The second passageway 62 may be of an elongated tubular shape with a small diameter that is angled upward as it extends to the outer edge of the retainer 36. The piston bore 64 may be a recess located in the center of the bottom of the retainer 36 that couples with the second passageway 62 and may be bounded by a fourth resilient O-ring 66. The second passageway 62 and the piston bore 64 may also couple with the first passageway 24, the pressurized chamber 34, and the port 42. The pressurized fluid may be contained in the pressurized chamber 34 by the first O-ring 50, the second O-ring 58, the third O-ring 60, and the fourth O-ring 66.

The plunger 28 is generally cylindrical or rod shaped with a uniform outer diameter and an inner diameter that varies along the longitudinal axis of the plunger 28. The outer diameter of the plunger 28 may be slightly less than the inner diameter of the clamping sleeve 10. The plunger 28 is typically manufactured from a metal, such as stainless steel, and the outer surface of the plunger 28 is generally smooth.

The plunger 28 may be hollow with a first inner recess 70 and a second inner recess 72 in the lower portion of the plunger 28, as seen in FIG. 7. When the plunger 28 is positioned within the body 32 and the clamping sleeve 10, the first inner recess 70 of the plunger 28 may align with the middle tier 54 of the retainer 36, and the second inner recess 72 may align with the upper tier 52, such that the plunger 28 may move generally freely within the clamping sleeve 10 with the bottom of the plunger 28 contacting the upper surface of the lower tier 56 when the plunger 28 is at its lowest point of travel. While the plunger 28 is operable to move freely within the clamping sleeve 10, the plunger 28 and the retainer 36 may include other components, such as springs and other mechanisms, that force the plunger 28 to a certain default position within the clamping sleeve 10 and the body 32. Thus, to move the plunger 28 once it is assembled in the clamping sleeve 10 may require a force. In addition, there may be a contact bolt 74 that is threadably coupled to the top of the plunger 28 to provide cover for the inner chambers of the plunger 28 and to contact a surface of a work piece.

The clamping sleeve 10 and the work support 26 may operate as follows. The work support 26 may be used in a manufacturing environment and may be mounted or installed in order to support or stabilize work pieces, such as materials, components, or parts, during applications such as assembly, processing, machining, inspection, or the like. The plunger 28 may be clamped into a locked position after the work piece is in position. The work piece may generally provide an axial load to the plunger 28, but the load may also be a rotational load that is applied to the plunger 28.

To clamp the plunger 28 in a fixed position, the flowable medium may enter the retainer 36 from the port 42. The flowable medium may flow through the port 42, the piston bore 64, the second passageway 62, the first passageway 24, and enter the pressurized chamber 34. Once in the chamber 34, the fluid may assert a generally uniform pressure on the outer surface of the tubular sidewall 12 section of the clamping sleeve 10. Pressure on the outer surface of the tubular sidewall 12 may induce a flexing of the corrugations 18 such that the circumference of the inner surface of the tubular sidewall 12 decreases such that the inner surface of the clamping sleeve 10 may contact the outer surface of the plunger 28. As the pressure from the flowable medium increases, the clamping sleeve 10 exerts a radially inward force on the plunger 28, rigidly holding the plunger 28 in a fixed position.

The clamping force may be reduced to zero and the clamping sleeve 10 may return to its default relaxed circumference by removing the pressure from the chamber 34.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A clamping sleeve for applying a clamping force to an object, the sleeve comprising:

a tubular sidewall with a first inner radius and a first outer radius, the tubular sidewall including at least one corrugation with a second inner radius and a second outer radius such that the first inner radius is different from the second inner radius and the first outer radius is different from the second outer radius;

an upper crown positioned at an upper end of the tubular sidewall; and a lower crown positioned at a lower end of the tubular sidewall, the lower crown in combination with the upper crown operable to retain a pressurized flowable medium therebetween, wherein the at least one corrugation allows the clamping sleeve to flex such that the circumference of the tubular sidewall decreases when the exterior of the tubular sidewall is exposed to a first level of pressure from the pressurized flowable medium, thereby applying the clamping force to the object located within an inner diameter of the clamping sleeve.

2. The sleeve of claim 1, wherein the at least one corrugation is axially aligned.

3. The sleeve of claim 1, wherein the at least one corrugation is angularly aligned.

4. The sleeve of claim 1, wherein the at least one corrugation is helically aligned.

5. The sleeve of claim 1, wherein the at least one corrugation is formed by creating at least one recess on an inner surface of the tubular sidewall and at least two adjacent half recesses on an outer surface of the tubular sidewall that are adjacent to the one recess on the inner surface of the tubular sidewall.

6. The sleeve of claim 1, wherein the object is cylindrical in shape with an outer diameter that is slightly less than the inner diameter of the clamping sleeve and operable to receive a load.

7. The sleeve of claim 1, wherein a second level of pressure, less than the first level, decreases the circumference of the tubular sidewall so that the tubular sidewall contacts the object.

8. The sleeve of claim 1, wherein the first inner radius is greater than the second inner radius and the first outer radius is greater than the second outer radius.

9. The sleeve of claim 1, wherein the first inner radius is less than the second inner radius and the first outer radius is less than the second outer radius.

10. The sleeve of claim 1, wherein the at least one corrugation has an arcuate cross-sectional shape.

11. A clamping sleeve for applying a clamping force to an object, the sleeve comprising:

a tubular sidewall of an elongated cylindrical shape with a hollow interior and a first inner radius and a first outer radius, the tubular sidewall including a plurality of arcuate corrugations, each corrugation having a second inner radius and a second outer radius such that the first inner radius is different from the second inner radius and the first outer radius is different from the second outer radius;

an upper crown positioned at an upper end of the clamping sleeve; and a lower crown positioned at a lower end of the clamping sleeve, the lower crown in combination with the upper crown operable to retain a pressurized flowable medium therebetween, wherein the corrugations allow the clamping sleeve to flex such that the circumference of the tubular sidewall decreases when the exterior of the tubular sidewall is exposed to a first level of pressure from the pressurized flowable medium, thereby applying the clamping force to the object located within an inner diameter of the clamping sleeve.

12. The sleeve of claim 11, wherein the plurality of corrugations are axially aligned.

13. The sleeve of claim 11, wherein the plurality of corrugations are angularly aligned.

14. The sleeve of claim 11, wherein the plurality of corrugations are helically aligned.

15. The sleeve of claim 11, wherein the plurality of corrugations are formed by creating a plurality of recesses on an inner surface of the tubular sidewall and a plurality of recesses on an outer surface of the tubular sidewall that are interleaved with the plurality of recesses on the inner surface of the tubular sidewall.

16. The sleeve of claim 11, wherein the object is cylindrical in shape with an outer diameter that is slightly less than the inner diameter of the clamping sleeve.

17. The sleeve of claim 11, wherein a second level of pressure, less than the first level, decreases the circumference of the tubular sidewall so that the tubular sidewall contacts the object.

18. A clamping mechanism, the clamping mechanism comprising:

a body with a hollow cylindrical interior;

a pressure chamber positioned within the body and operable to retain a pressurized flowable medium;

an object of an elongated cylindrical shape operable to receive an external load; and a clamping sleeve of an elongated cylindrical shape with a hollow interior positioned within the body adjacent to the pressure chamber and including at least one corrugation, wherein the at least one corrugation allow the clamping sleeve to flex such that the circumference of the clamping sleeve decreases when a pressure within the pressure chamber reaches a first level, thereby applying a clamping force to the object located within an inner diameter of the clamping sleeve.

19. The clamping mechanism of claim 18, wherein the clamping sleeve includes a plurality of axially-aligned corrugations.

20. The clamping mechanism of claim 18, wherein the tubular sidewall includes a first inner radius and a first outer radius and the at least one corrugation includes a second inner radius and a second outer radius such that the first inner radius is different from the second inner radius and the first outer radius is different from the second outer radius.

21. The clamping mechanism of claim 18, wherein a second level of pressure, less than the first level, decreases the circumference of the clamping sleeve so that the clamping sleeve contacts the object.

* * * * *